US007814683B2

(12) United States Patent
Lee

(10) Patent No.: US 7,814,683 B2
(45) Date of Patent: Oct. 19, 2010

(54) HEALTH FOOTWEAR HAVING IMPROVED HEEL

(75) Inventor: Ho-Hyoung Lee, Busan (KR)

(73) Assignee: RYN Korea Co., Ltd. (KR)

( * ) Notice: Subject to any disclaimer, the term of this patent is extended or adjusted under 35 U.S.C. 154(b) by 742 days.

(21) Appl. No.: 11/718,538

(22) PCT Filed: Dec. 13, 2005

(86) PCT No.: PCT/KR2005/004251

§ 371 (c)(1),
(2), (4) Date: May 3, 2007

(87) PCT Pub. No.: WO2006/065047

PCT Pub. Date: Jun. 22, 2006

(65) Prior Publication Data

US 2009/0056165 A1 Mar. 5, 2009

(30) Foreign Application Priority Data

Dec. 15, 2004 (KR) ..... 20-2004-0035581 U
Dec. 7, 2005 (KR) ..... 10-2005-0118559

(51) Int. Cl.
*A43B 13/18* (2006.01)

(52) U.S. Cl. ..... 36/28; 36/37; 36/25 R

(58) Field of Classification Search ..... 36/88, 36/107, 108, 76 R, 25 R, 30 R, 28, 29, 35 R, 36/37

See application file for complete search history.

(56) References Cited

U.S. PATENT DOCUMENTS 4,030,213 A * 6/1977 Daswick ..... 36/30 R
6,341,432 B1 * 1/2002 Muller ..... 36/27
6,477,791 B2 * 11/2002 Luthi et al. ..... 36/31
6,843,000 B1 * 1/2005 Park ..... 36/29
6,968,637 B1 * 11/2005 Johnson ..... 36/88
7,401,418 B2 * 7/2008 Wyszynski et al. ..... 36/28
2006/0277791 A1 * 12/2006 Schoenborn et al. ..... 36/28
2007/0113425 A1 * 5/2007 Wakley et al. ..... 36/28
2007/0294915 A1 * 12/2007 Ryu et al. ..... 36/28

FOREIGN PATENT DOCUMENTS

KR 19880001628 9/1988
KR 200213820 12/2000
KR 200301687 1/2003
KR 200321714 7/2003

OTHER PUBLICATIONS

International Search Report; PCT/KR2005/004251; Mar. 23, 2006.

* cited by examiner

*Primary Examiner*—Marie Patterson
(74) *Attorney, Agent, or Firm*—Cantor Colburn LLP

(57) ABSTRACT

Disclosed is a midsole (22) for a healthy shoe, which is easily and simply manufactured and comprises a tunnel portion (28) or an airbag (128) formed therein so that impact caused by the landing of a heel of the healthy shoe on the ground in a landing step and a gravity center-transferring step is uniformly applied to the heel of the shoe due to the rolling of the heel on the ground and discontinuous impact is not transferred to various parts of the body of a user, such as an ankle joint and a leg, and a method for manufacturing the same, thereby allowing the user to smoothly land on the ground and walk stably.

2 Claims, 5 Drawing Sheets

HEALTH FOOTWEAR HAVING IMPROVED HEEL

TECHNICAL FIELD

The present invention relates to a midsole for a healthy shoe and a method for manufacturing the same, and more particularly to a midsole for a healthy shoe, which is easily and simply manufactured and comprises a tunnel portion or an airbag formed therein so that impact caused by the landing of a heel of the healthy shoe on the ground in a landing step and a gravity center-transferring step is uniformly applied to the heel of the shoe due to the rolling of the heel on the ground and discontinuous impact is not transferred to various parts of the body of a user, such as an ankle joint and a leg, and a method for manufacturing the same, thereby allowing the user to smoothly land on the ground and walk stably.

BACKGROUND ART

In general, the motion of a foot on the ground during walking is performed by three steps, i.e., landing a heel of the foot on the ground, transferring a gravity center from the heel of the foot to a tiptoe of the foot, and causing the tiptoe to be separated from the ground by pushing off from the ground. The motions of right and left feet of a person are alternately repeated. In most conventional shoes, a heel has a shape approximately orthogonal to the ground. Particularly, in the above landing step of a dress shoe comprising a heel provided with a sharp edge, the sharp edge first contacts the ground. Since the edge of the heel has a linear shape having a small contact area with the ground, impact applied to the heel in the landing step is increased and the change from the landing step to the gravity center-transferring step is rapidly achieved. Thereby, the impact is transferred to various parts of the body of a user, such as an ankle joint, a leg and respective joints of the body, thus causing the user to feel instability when landing and not to walk stably.

DISCLOSURE

Technical Problem

Therefore, the present invention has been made in view of the above problems, and it is an object of the present invention to provide a midsole for a healthy shoe, which is easily and simply manufactured and comprises a tunnel portion or an airbag formed therein so that impact caused by the landing of a heel of the healthy shoe on the ground in a landing step and a gravity center-transferring step is uniformly applied to the heel of the shoe due to the rolling of the heel on the ground and discontinuous impact is not transferred to various parts of the body of a user, such as an ankle joint and a leg, and a method for manufacturing the same, thereby allowing the user to smoothly land on the ground and walk stably.

Technical Solution in accordance with an aspect of the present invention, the above and other objects can be accomplished by the provision of a midsole for a healthy shoe, which has a leather, a liner, the midsole, and an outsole, comprising: a shank inserted into the midsole, and comprising a plurality of slits, front ends of which are opened, formed at designated positions of the front part thereof for dividing the front part of the shank into plural portions, and ribs made of a material having a high elasticity and installed in the lengthwise direction for reinforcing the strength of the shank; and a midsole tunnel portion formed in a heel part of the midsole so that the tilt angle of the heel part on the ground is in the range of 0~40 degrees, or an airbag installed in the heel part of the midsole, wherein the bottom surface of a heel part of a sole of the healthy shoe has a curved shape corresponding to the shape of a heel of a foot of a user and a trajectory of motion of the heel against an ankle joint so that the bottom surface of the heel part of the sole of the healthy shoe rolls on the ground during walking.

The midsole may further comprise an upper pad comprising a tunnel portion having a semi-oval shape, formed by cutting off the heel part thereof, and tilted on the ground at an angle in the range of 0~40 degrees, and 1~20 support protrusions formed on the upper surface of the tunnel portion; and a lower pad comprising a tunnel portion having a semi-oval shape symmetrical with the shape of the upper pad and tilted on the ground at an angle in the range of 0~40 degrees, and 1~20 support protrusions formed on the lower surface of the tunnel portion at positions corresponding to the support protrusions of the upper pad, wherein the edge of the tunnel portion of the lower pad is bonded to the edge of the tunnel portion of the upper pad, under the condition the support protrusions of the upper pad contact the support protrusions of the lower pad or the support protrusions of the upper pad are bonded to the support protrusions of the lower pad by an adhesive, so as to form the midsole tunnel portion.

1~20 springs surrounding the support protrusions of the upper pad and the support protrusions of the lower pad, under the condition the support protrusions of the upper pad contact the support protrusions of the lower pad or the support protrusions of the upper pad are bonded to the support protrusions of the lower pad by an adhesive, may be installed in the tunnel portion of the midsole.

The outsole having a heel part having a curved shape tilted on the ground at an angle in the range of 0~40 degrees may be attached to the midsole.

In accordance with another aspect of the present invention, there is provided a method for manufacturing a midsole for a healthy shoe, which has a leather, a liner, the midsole, and an outsole, comprising: preparing an upper pad comprising a tunnel portion having a semi-oval shape, formed by cutting off the heel part thereof, and tilted on the ground at an angle in the range of 0~40 degrees, and 1~20 support protrusions formed on the upper surface of the tunnel portion; preparing a lower pad comprising a tunnel portion having a semi-oval shape symmetrical with the shape of the upper pad and tilted on the ground at an angle in the range of 0~40 degrees, and 1~20 support protrusions formed on the lower surface of the tunnel portion at positions corresponding to the support protrusions of the upper pad; and connecting the edge of the tunnel portion of the lower pad to the edge of the tunnel portion of the upper pad, under the condition the support protrusions of the upper pad contact the support protrusions of the lower pad or the support protrusions of the upper pad are bonded to the support protrusions of the lower pad by an adhesive, so as to form a midsole tunnel portion in the midsole.

ADVANTAGEOUS EFFECTS

The midsole for a healthy shoe of the present invention is easily and simply manufactured and comprises a tunnel portion or an airbag formed therein so that impact caused by the landing of the healthy shoe on the ground is uniformly applied to a heel of the healthy shoe due to the rolling of the heel on the ground and discontinuous impact is not transferred to various parts of the body of a user, such as an ankle joint and a leg, and a method for manufacturing the same, thereby allowing a user to smoothly land on the ground and walk stably.

DESCRIPTION OF DRAWINGS

The above and other objects, features and other advantages of the present invention will be more clearly understood from the following detailed description taken in conjunction with the accompanying drawings, in which.

BEST MODE

Now, preferred embodiments of the present invention will be described in detail with reference to the annexed drawings.

Figure 12:
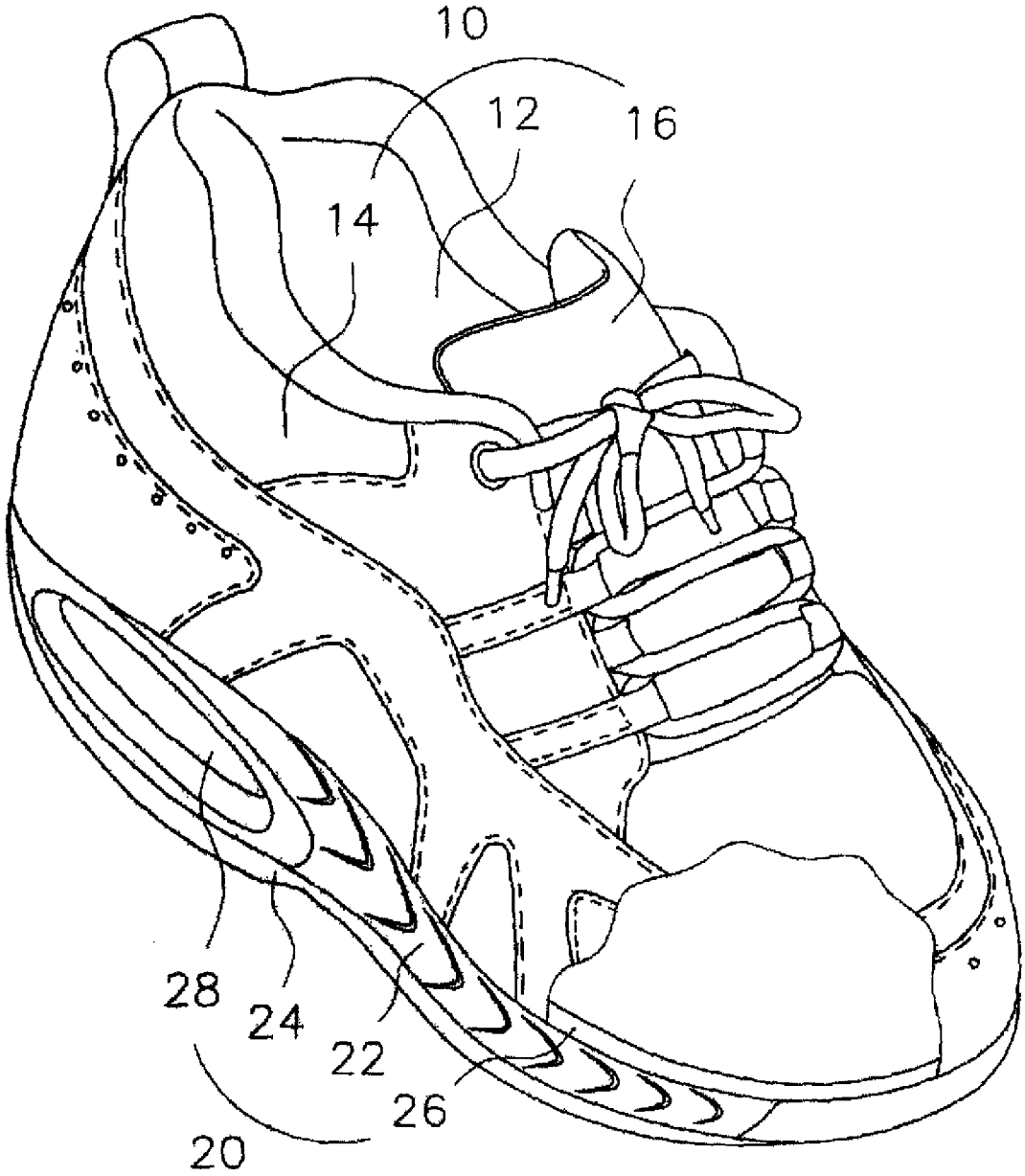
FIG. 12 is a perspective view of a shoe having the midsole of the present invention installed therein.

As shown in FIG. 12, a healthy shoe having a midsole of the present invention installed therein comprises a leather 10 and a sole 20. The leather 10 comprises an inner leather 12 and an outer leather 14, and the sole 20 comprises a midsole 22 and an outsole 24. As shown in FIGS. 1 to 8, in order to manufacture the midsole 22 of the present invention, an upper pad 110 and a lower pad 120 are separately manufactured. Then, under the condition that support protrusions 114 of the upper pad 110 contact support protrusions 124 of the lower pad 120 formed at positions corresponding to the support protrusions 114, the edge of a tunnel portion 122 of the lower pad 120 is bonded to the edge of a tunnel portion 112 of the upper pad 110 so that a midsole tunnel portion 28 is obtained. The midsole 22 manufactured by the above process is installed in a shoe. The support portions 114 and 124 of the upper and lower pads 110 and 120 of the midsole 22 are made of synthetic resin or synthetic rubber produced from elastic body. Preferably, the support portions 114 and 124 are made of polyurethane.

As shown in FIGS. 1 to 8, the tunnel portion 112 having a semi-oval shape is formed on the upper pad 110 of the midsole 22 of the present invention by cutting off a heel part of the upper pad 110 such that the tilt angle of the tunnel portion 112 on the ground is in the range of 0~40 degrees, and 1~20 support protrusions 114 are formed on the upper surface of the tunnel portion 112. Tunnels formed in the midsole tunnel portion 28 of the midsole 22 of the present invention serves to reduce the rigidity of the midsole 22 to half of that of a midsole not having tunnels, thereby increasing a buffering effect.

As shown in FIGS. 5 to 8, springs 130 are installed in the midsole tunnel portion 28 of the midsole 22 of the present invention, and serve to reduce the rigidity of the midsole 22 to half of that of a midsole not having springs, thereby increasing the buffering effect.

Figure 1:
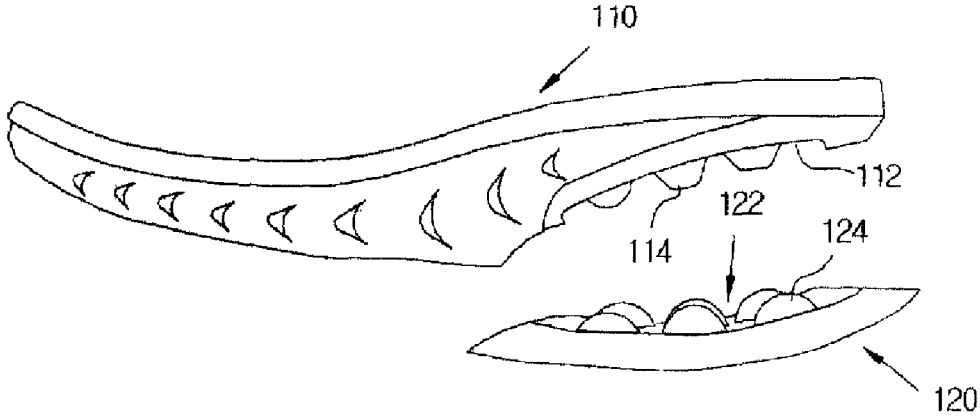
FIG. 1 is a disassembled perspective view of a midsole provided with a tunnel portion formed therein in accordance with the present invention.
Figure 2:
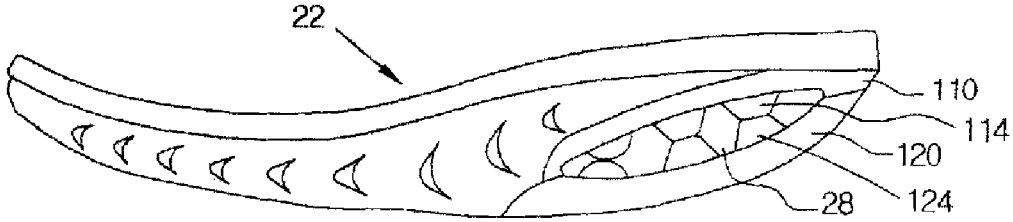
FIG. 2 is an assembled perspective view of the midsole provided with the tunnel portion formed therein in accordance with the present invention.
Figure 3:
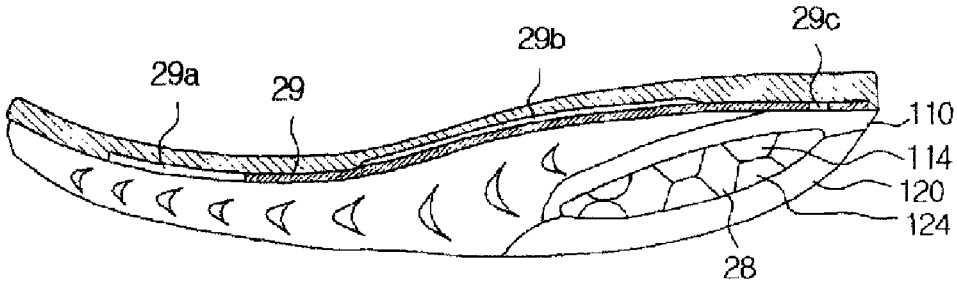
FIG. 3 is an assembled perspective view of the midsole provided with the tunnel portion formed therein, into which a shank is inserted, in accordance with the present invention.
Figure 4:
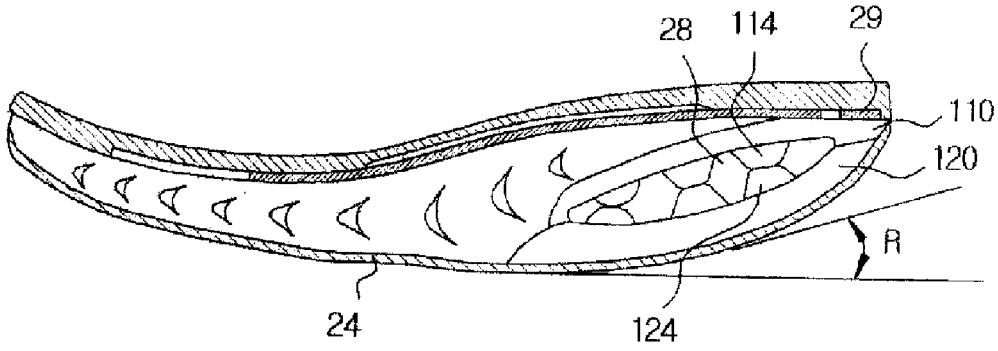
FIG. 4 is an assembled perspective view of the midsole provided with the tunnel portion formed therein, to which an outsole is attached, in accordance with the present invention.
Figure 5:
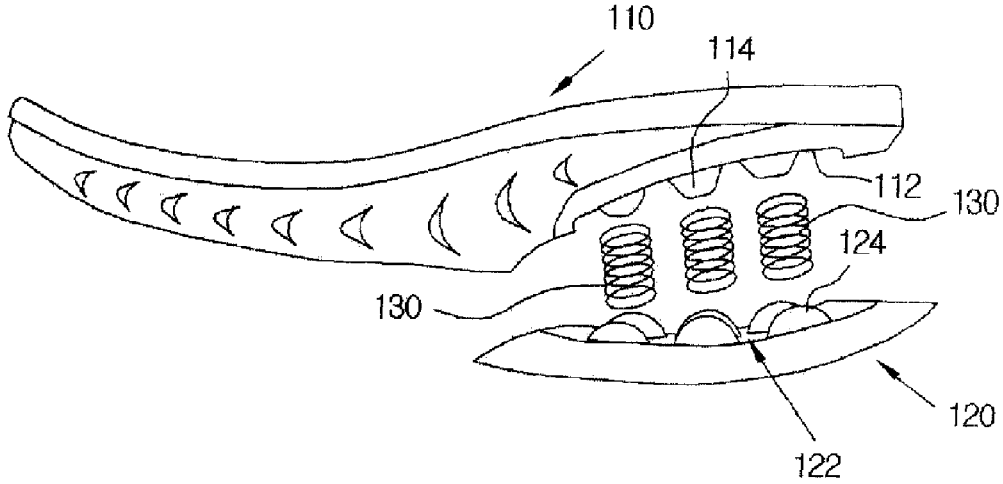
FIG. 5 is a disassembled perspective view of the midsole provided with the tunnel portion formed therein, in which springs are installed, in accordance with the present invention.
Figure 6:
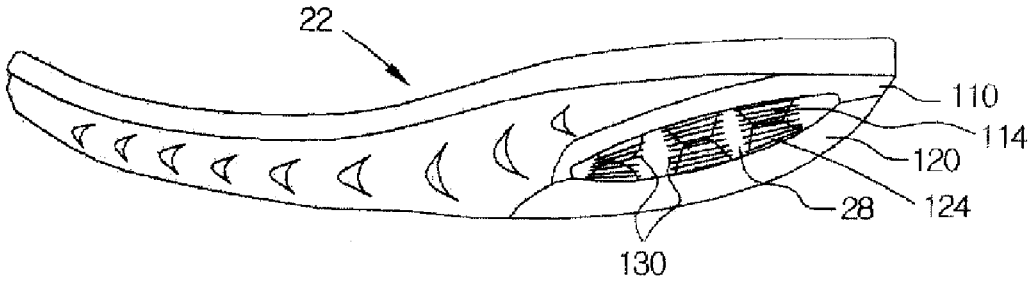
FIG. 6 is an assembled perspective view of the midsole provided with the tunnel portion formed therein, in which the springs are installed, in accordance with the present invention.
Figure 7:
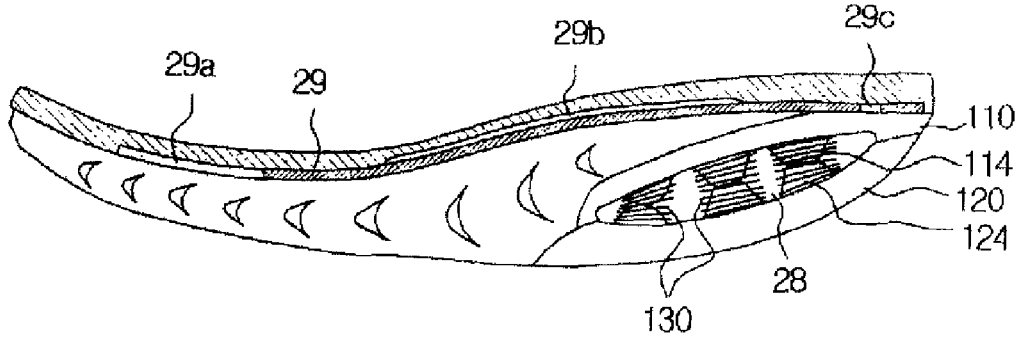
FIG. 7 is an assembled perspective view of the midsole provided with the tunnel portion formed therein, into which a shank is inserted, in accordance with the present invention.
Figure 8:
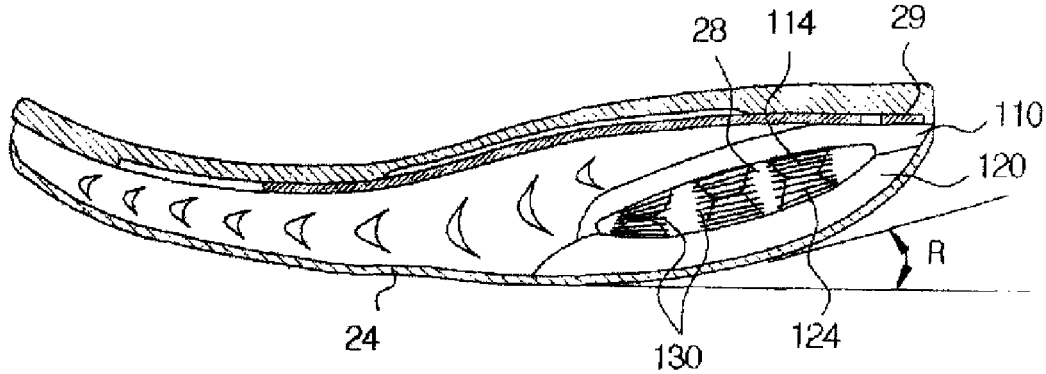
FIG. 8 is an assembled perspective view of the midsole provided with the tunnel portion formed therein, to which an outsole is attached, in accordance with the present invention.
Figure 9:
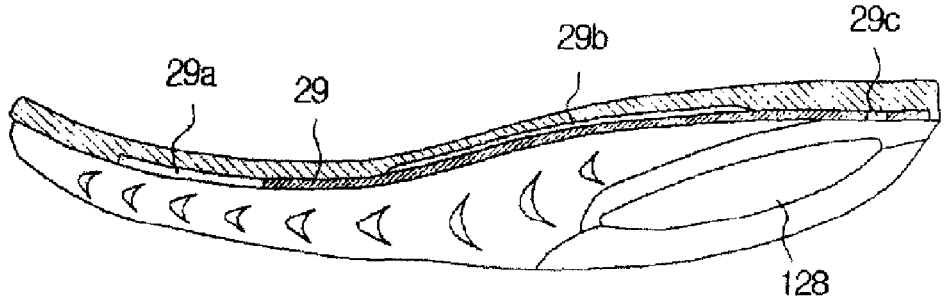
FIG. 9 is an assembled perspective view of the midsole provided with the tunnel portion formed therein, in which an airbag is installed, in accordance with the present invention.

As shown in FIG. 9, an airbag 128 having a semi-oval shape is formed in the midsole 22 such that the tilt angle of the heel part of the midsole 22 on the ground is in the range of 0~40 degrees. The airbag 128 installed in the midsole 22 and tunnels formed in the airbag 128 serve to reduce the rigidity of the midsole 22 to half of that of a midsole not having an airbag and tunnels, thereby increasing the buffering effect.

When the tilt angle of the tunnel portion 112 of the upper pad 110 of the midsole 22 on the ground is 0, the midsole 22 produces a shoe having a flat heel. Further, when the tilt angle of the tunnel portion 112 of the upper pad 110 of the midsole 22 on the ground is in the range of 0~40 degrees, and preferably in the range of 20~40 degrees, the midsole 22 produces a shoe having a heel, the bottom surface of which is smoothly curved so that the tilt angle of the heel on the ground is gradually increased from the front portion of the heel to the rear portion of the heel. The midsole 22 of the present invention has the heel part, the bottom surface of which is smoothly curved so that the tilt angle of the heel pad on the ground is gradually increased from the front portion of the heel part to the rear portion of the heel part. Preferably, the curved shape of the bottom surface of the heel part corresponds to a shape of a heel of a foot and a trajectory of motion of the heel against an ankle joint. In order to satisfy requirements in human body engineering, the tilt angle (R) of the heel part of the midsole 22 on the ground is in the range of 0~40 degrees. The tilt angle (R) is calculated from the average angle between the heel part of the midsole 22 and the ground when landing.

As shown in FIGS. 1 to 8, the tunnel portion 112 of the upper pad 110 comprises 1~20 support protrusions 114, and preferably 5~10 support protrusions 114 formed on the upper surface thereof, and the midsole tunnel portion 28 is laid in parallel with the ground in the landing step under the condition that the support protrusions 114 of the upper pad 110 contact the lower support protrusions 124 of the lower pad 120 formed at positions corresponding to the support protrusions 114, thereby increasing buffering efficiency due to contraction. Further, the tunnel portion 28, which is contracted in the landing and gravity center-transferring steps, is returned to its original shape in the separating step, thereby generating repulsive force and thus increasing walking efficiency. The tunnel portion 28 of the midsole 22 of the present invention may be manufactured by causing the support protrusions 114 of the upper pad 110 to contact the support protrusions 124 of the lower pad 120, or by bonding the support protrusions 114 of the upper pad 110 to the support protrusions 124 of the lower pad using all adhesive.

As shown in FIGS. 1 to 8, the tunnel portion 122 having an semi-oval shape symmetrical with the tunnel portion 112 of the upper pad 120 is formed on the lower pad 120 of the midsole 22 of the present invention such that the tilt angle of the tunnel portion 122 on the ground is in the range of 0~40 degrees, and preferably in the range of 20~40, and 1~20 support protrusions 124, and preferably 5~10 support protrusions 124 are formed on the lower surface of the tunnel portion 122 at positions corresponding to the support protrusions 114 of the upper pad 110.

A healthy shoe having the midsole 22 of the present invention is the same as a conventional shoe in that the bottom surface of the heel part of the midsole 22 is horizontally even so as to assure the horizontal stability during walking. In the healthy shoe having the midsole 22 of the present invention, the outsole 24 is connected to the bottom surface of the midsole 22 along the curve of the midsole 22 so that the curved shape of bottom surface of the heel part of the midsole 22 is maintained. The midsole tunnel portion 28 is formed in the heel part of the midsole 22 installed in the healthy shoe of the present invention. Preferably, the tunnel portion 28 is formed in the heel part of the midsole 22 under the condition that the tunnel portion 28 is slanted at the same angle as the tilt angle (R) along the slantedly curved shape. The tilting of the tunnel portion 28 is due to the average angle between the heel part of the midsole 22 and the ground in the landing step. Tunnels formed in the tunnel portion 28 of the midsole 22 serve to reduce the rigidity of the midsole 22 to half of that of a midsole not having tunnels so as to increase the buffering effect, and to allow the tunnel portion 28 to be laid in parallel with the ground in the landing step so as to improve buffering efficiency due to contraction. Further, the tunnel portion 28, which is contracted in the landing and gravity center-transferring steps, is returned to its original shape in the separating step, thereby generating repulsive force and thus increasing walking efficiency.

Figure 10:
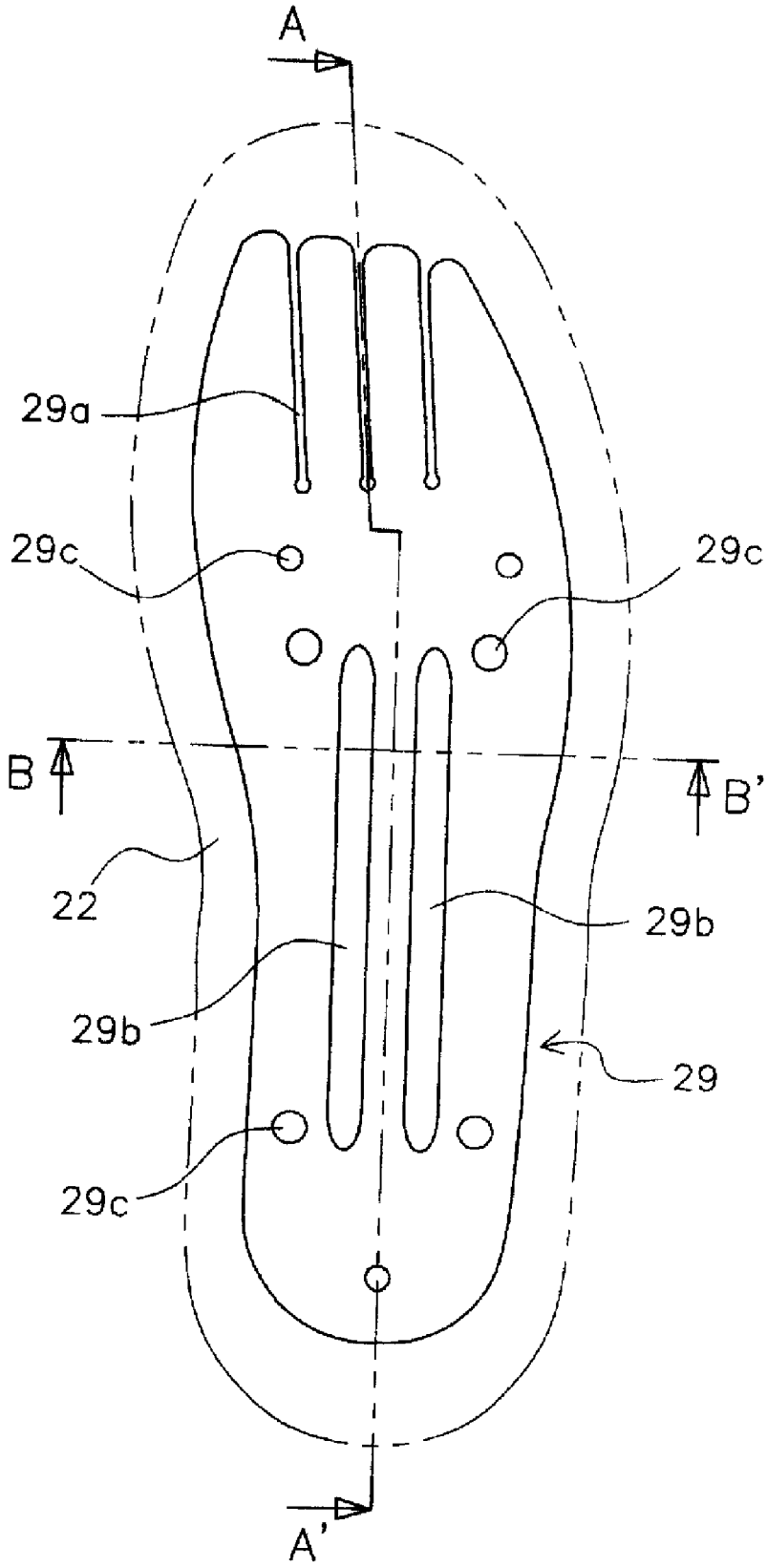
FIG. 10 is a plan view of a sole having the midsole provided with the tunnel portion formed therein, into which a shank is inserted, in accordance with the present invention.
Figure 11:
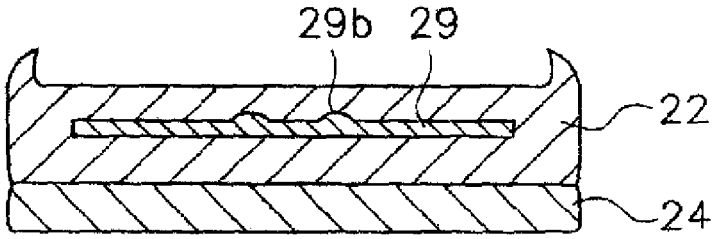
FIG. 11 is a sectional view taken along the line B-B' of FIG. 10.

As shown in FIGS. 10 and 11, a shank 29 made of a material having a high elasticity is inserted into the midsole 22 of the present invention. The shank 29 retains original forms of the healthy shoe having the midsole 22 and the sole 20 of the healthy shoe, restores the sole 20, which is frequently bent and extended during walking, to its original shape, improves the stability of the shoe during walking, and applies the repulsive force to the shoe in the separating step, thereby assisting a user to walking lightly. The shank 29 of the midsole 22 of the present invention may have various shapes and be made of various materials. Preferably, the shank 29 is made of a synthetic resin, such as Poly Vinyl Chloride (PVC), and has a plate shape corresponding to the appearance and curved shape of the midsole 22. A plurality of slits 29*a*, front ends of which are opened, are formed at designated positions of the front part of the shank 29 having a relatively high bending angle during walking. The silts 29*a* divide the front part of the shank 29 into a plurality of portions, thereby allowing the tiptoe of the shoe having the midsole 22 to be easily bent. Ribs 29*b* for reinforcing the strength of the shank 29 having an extended shape in the lengthwise direction are formed on the central portion of the shank 29, and a plurality of through holes 29*c* for passing a molding solution when the midsole 22 is manufactured are formed in the central portion of the shank 29.

The inner leather 12 and a liner 26 of the leather 10 of the healthy shoe having the midsole 22 of the present invention are made of a silver thread, thus containing a silver component. Preferably, the inner leather 12 of a tongue 16 of the leather 10 is made of a silver thread, also. The liner 26 may be formed by various methods. Preferably, a nonwoven fabric made of a silver thread is attached to the surface of the liner 26 or is inserted into the inner layer of the liner 26.

The movement of a foot of a user wearing the healthy shoe having the midsole 22 of the present invention during walking is divided into three steps, i.e., the landing step, the gravity center-transferring step, and the separating step. In the landing step, the heel of the healthy shoe of the midsole 22 of the present invention contacts the ground. Since the sole 20 of the heel of the healthy shoe has a large contact area with the ground, the amount of impact applied to the healthy shoe due to the landing is reduced. Further, since the tunnel portion 28 of the midsole 22 is contracted under the condition that the tunnel portion 28 is parallel with the ground, the buffering efficiency is increased and the foot of the user wearing the healthy shoe smoothly lands on the ground. The tunnels formed in the tunnel portion 28 of the midsole 22 serves to reduce the rigidity of the midsole 22 to half of that of a midsole not having tunnels, thus increasing the buffering effect. In the gravity center-transferring step, the curved bottom surface of the heel of the healthy shoe having the midsole 22 of the present invention rolls along the ground, and the impact is continuously dispersed and absorbed by the bottom surface of the healthy shoe. Since the center of the healthy shoe is transferred along the curved bottom surface, sudden impact is not transferred to an ankle joint, a leg, and other joints of the body of the user so that the user can walk stably. In the separating step, the heel of the sole 20 of the healthy shoe having the midsole 22 of the present invention is separated from the ground. At this time, the tunnel portion 28 or the airbag 128, which was contracted in the previous steps, is returned to its original shape, thereby generating repulsive force. The repulsive force allows the foot of the user wearing the healthy shoe to move in the walking direction, thus increasing the walking efficiency and allowing the user to walk lightly.

The shank 29 inserted into the midsole 22 retains original forms of the healthy shoe having the midsole 22 and the sole 20 of the healthy shoe, restores the sole 20, which is frequently bent and extended during walking, to its original shape, and elastically and firmly maintains the shape of the sole 20, thereby improving the stability of the healthy shoe during walking. Further, the shank 29 applies the repulsive force generated in the separating step to the healthy shoe, and pushes the tiptoe of the foot of the user wearing the healthy shoe in the walking direction, thereby assisting the user to walk lightly and increasing the walking efficiency.

The inner leather 12 and the liner 26 of the leather 10 of the healthy shoe having the midsole 22 of the present invention contain a silver component, thereby exhibiting antibacterial action for preventing the propagation of bacteria and preventing the generation of noise. Accordingly, the healthy shoe is good for the user's feet, prevents athlete's foot and eczema, and is useful to pedestrians having the sensitive skin.

INDUSTRIAL APPLICABILITY

As apparent from the above description, the present invention provides a midsole for a healthy shoe, which is easily and simply manufactured and comprises a tunnel portion or an airbag formed therein so that impact caused by the landing of a heel of the healthy shoe on the ground in a landing step and a gravity center-transferring step is uniformly applied to the heel of the shoe due to the rolling of the heel on the ground and discontinuous impact is not transferred to various parts of the body of a user, such as an ankle joint and a leg, and a method for manufacturing the same, thereby allowing the user to smoothly land on the ground and walk stably.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A health footwear, which has a leather, a liner, a midsole, and an outsole, the midsole comprising:

an upper pad comprising a first tunnel portion having a semi-oval shape, formed by cutting off the heel part thereof and tilted on the ground at an angle in the range of 0~40 degrees, and 1-20 first support protrusions formed on an upper surface of the first tunnel portion;

a lower pad comprising a second tunnel portion having a semi-oval shape symmetrical with the shape of the first tunnel portion of the upper pad and tilted on the ground at an angle in the range of 0~40 degrees, and 1-20 second support protrusions formed on a lower surface of the second tunnel portion at positions corresponding to the first support protrusions of the upper pad, wherein the edge of the second tunnel portion of the lower pad is bonded to the edge of the first tunnel portion of the upper pad in such a manner that the first support protrusions of the upper pad contact the second support protrusions of the lower pad, or the first support protrusions of the upper pad are bonded to the second support protrusions of the lower pad by an adhesive, so as to form a midsole tunnel portion, and wherein a spring is installed around the first and second support protrusions; and a shank inserted into the midsole, and comprising a plurality of slits, front ends of which are opened, formed at designated positions for dividing the front part of the shank into plural portions, and ribs made of a material having a high elasticity and installed in the lengthwise direction for reinforcing the strength of the shank.

2. The health footwear as set forth in claim 1, wherein the outsole having a heel part having a curved shape tilted on the ground at an angle in the range of 0-40 degrees is attached to the midsole.

* * * * *